United States Patent [19]

Nakano et al.

[11] Patent Number: 4,608,949

[45] Date of Patent: Sep. 2, 1986

[54] TWO-CYCLE ENGINE

[75] Inventors: Yasuhiko Nakano, Saitama; Shigemitsu Akutsu, Tokyo, both of Japan

[73] Assignee: Honda Giken Kogyo Kabushiki Kaisha, Tokyo, Japan

[21] Appl. No.: 647,588

[22] Filed: Sep. 5, 1984

[30] Foreign Application Priority Data

Sep. 5, 1983 [JP] Japan ..... 58-163086

[51] Int. Cl.[4] ..... F02B 33/04

[52] U.S. Cl. ..... 123/73 A; 123/73 D; 123/73 V

[58] Field of Search ..... 123/73 A, 73 R, 73 D, 123/73 V, 73 PP

[56] References Cited

U.S. PATENT DOCUMENTS

| | | | |
|---|---|---|---|
| 873,857 | 12/1907 | Grade | 123/73 A |
| 3,690,304 | 9/1972 | Schneider et al. | 123/73 A |
| 4,202,298 | 5/1980 | Boyesen | 123/73 A |
| 4,276,858 | 7/1981 | Jaulmes | 123/73 A |
| 4,318,373 | 3/1982 | Soubis | 123/73 R |
| 4,474,145 | 10/1984 | Boyesen | 123/73 A |

FOREIGN PATENT DOCUMENTS

| | | | |
|---|---|---|---|
| 2743780 | 4/1979 | Fed. Rep. of Germany | 123/73 A |
| 2386684 | 12/1978 | France | 123/73 A |
| 154125 | 11/1981 | Japan | 123/73 A |
| 84459 | 6/1936 | Sweden | 123/73 D |
| 17054 | of 1912 | United Kingdom | 123/73 D |
| 298171 | 10/1928 | United Kingdom | 123/73 A |

*Primary Examiner*—Magdalen Y. C. Greenlief
*Attorney, Agent, or Firm*—Armstrong, Nikaido, Marmelstein & Kubovcik

[57] ABSTRACT

A two-cycle engine with an intake port extending perpendicularly to a crankshaft, wherein the intake port is directed substantially parallel with a tangential line a crank web defines at its top point on the side of a cylinder. A cylinder skirt portion fronting an end opening of the intake port at the cylinder side has a part thereof cut, while keeping its length in the axial direction of the cylinder. The two-cycle engine further includes a rotary valve mechanism having a rotary valve cover covering a rotary disc, the rotary valve cover being formed with an intake hole, and an intake tube connecting the intake hole to a carburetor, and the intake tube is integrally jointed to the intake hole. The two-cycle engine further includes a valve guide plate supporting the rotary disc, an engine body has formed in its upper face a mount seat for the valve guide plate, the mount seat being formed with a recess, the valve guide plate has a mount face fittable to the mount seat, the mount face being formed with another recess, and a breather chamber is constituted with the recesses.

7 Claims, 13 Drawing Figures

TWO-CYCLE ENGINE

BACKGROUND OF THE INVENTION

1. Field of the Invention

The present invention relates to a two-cycle engine, and particularly to a rotary valve type two-cycle engine.

2. Description of Prior Art

In a two-cycle engine to be equipped such as in a motorcycle, in order to raise the engine output, the intake resistance is needed to be possibly reduced, to thereby increase the efficiency of intake charge into a cylinder. For the reduction of intake resistance, it is generally effective to shorten the length of an intake path. In this respect, a best arrangement to shorten the intake path length includes a rotary valve directly provided at one end of a crankshaft, and a valve opening formed in a crankcase and connected to an intake port, while a carburetor is disposed just behind the intake port.

In this arrangement, however, the crankshaft is directed transversely of a vehicle body, so that the transverse width of engine is increased, thus restricting a banking angle in the case of a motorcycle which is let to bank when cornering.

For such reason, there has been proposed what is called a rotary intake valve backing type two-cycle engine, in which an intake port is arranged in the upper part of a crankcase perpendicularly to a crankshaft, thereby reducing the transverse width of the engine, and a rotary valve interlocked with the crankshaft is disposed in the intake port.

However, the rotary intake valve backing type engine necessarily requires a longer intake port than a side mount type engine which has, as described before, an intake port arranged in the axial direction of a crankshaft. In this respect, in a rotary intake valve backing type arrangement in which an intake port is disposed in the boundary region between a cylinder and a crankcase to thereby shorten the intake port length, the sectional area at that end opening of the intake port which is located on the cylinder side becomes restricted with a cylinder sleeve fronting the end opening. Moreover, in a modified arrangement in which the length of a cylinder skirt is cut short to secure a necessary sectional area at an end opening of an intake port, the cylinder skirt fails to effectively hold to support a piston which may thus be caused to unsteadily swayed, when approaching its bottom dead center.

Further, different from the case where a rotary valve is installed at either transverse side of a crankcase, thus permitting a carburetor to be directly mounted on a valve cover, in an arrangement having a rotary valve mounted from above on a crankcase as above-mentioned, the associated space layout generally requires an intake tube for connecting a carburetor to an intake hole formed through a valve corner, thus needing a clamp band or the like. In such arrangement, therefore, an annular extension for fitting thereon a clamp band is projectingly formed around an intake hole of a valve cover, whereas the necessary securement of space such as for the clamp band is to unsuccessfully shorten the intake tube length, thus failing to reduce the intake resistance, besides that an installation work of the intake tube in a confined space is quite troublesome.

On the other hand, in the field of internal combustion engine, to prevent pressure variations in an engine casing such as due to the variation of temperature, there is generally employed a breathing system including a breather chamber for effecting the breathing of air as separated from fuel-air mixture, the breather chamber consisting of a complicated route or the like formed in the engine casing. In the art of a two-cycle engine adapted to be mounted such as on a motorcycle and thus required to be possibly light-weighted and small of size, however, a sufficient space is difficult to secure for the capacity of such a breather chamber, whereas the securement of breathing capacity necessarily gives rise to an enlargement of the engine casing, resulting in a larger size, thus unsuccessfully achieving a light-weighted design. Particularly, in rotary valve type two-cycle engines, besides the before-described disadvantages as, there occur shortcomings such as various restrictions in the layout of a breathing system of which breather chamber is required to be arranged so as not to interfere with a rotary valve, thus frequently resulting in the difficulty of disposing the breathing system in a desired position.

The present invention has been achieved to effectively overcome such conventional problems in the art of a rotary valve type two-cycle engine.

SUMMARY OF THE INVENTION

According to the present invention, there is provided a two-cycle engine including an engine body having formed therein a crank chamber and an intake port for introducing fuel-air mixture from a carburetor installed outside of the engine body to the crank chamber, the engine body having therein a cylinder defining a cylinder chamber communicatable with the crank chamber and at least a cylinder skirt portion extending so as to block an end opening as a cylinder opening of the intake port, a piston slidably fitted in the cylinder, a crankshaft rotatably arranged in the crank chamber perpendicularly to the center axis of the cylinder, at least one substantially disc-like crank web fixed at the central part thereof to the crankshaft, and a connecting rod operatively interconnecting the crankshaft with the piston, in which the intake port extending in a direction perpendicular to the crankshaft, wherein the intake port is arranged so as to extend substantially along a tanential line the crank web defines at a top point thereof on the cylinder side.

In the two-cycle engine according to the invention, the cylinder skirt portion extending so as to block the end opening of the intake port may have a part thereof cut, while keeping the length thereof in the axial direction of the cylinder.

Moreover, the two-cycle engine may further include a rotary valve mechanism provided for the engine body and operatively connected to the crankshaft so as to open and close an end opening of the intake port on the carburetor side in accordance with the stroke of the piston, the rotary valve mechanism consisting of a valve shaft directed upright to extend perpendicularly to the crankshaft and operatively connected to the crankshaft, a rotary disc fixed at the central part thereof to the valve shaft and adapted to be located at a part thereof in the intake port so as to shut the intake port, the rotary disc having at least one valve opening, and a valve cover mounted on the engine body so as to cover the rotary disc and formed with an intake hole corresponding to the intake port, and an intake tube for connecting the intake hole of the valve cover to the carburetor, and the intake tube may be fastened to the intake hole of the valve cover so as to be integral therewith.

Further, the two-cycle engine may be such that the rotary valve mechanism further includes a valve guide plate of a predetermined thickness, the valve guide plate having a central support hole for rotatably supporting the valve shaft and an intake hole formed corresponding to the intake port, the engine body has in the upper face thereof a circular recess opened upwardly and formed at the bottom thereof as a mount seat for the valve guide plate, the bottom face of the valve guide plate is formed as a mount face fittable to the mount seat, the valve guide plate is fitted in the circular recess, the rotary disc is supported by the upper face of the valve guide plate, and a breather chamber is cooperatively constituted with a first recess formed in the mount seat of the engine body and a second recess formed correspondingly to the first recess in the mount face of the valve guide plate.

Accordingly, an object of the present invention is to provide a two-cycle engine, in which the charging efficiency of fuel-air mixture into a cylinder is raised by reducing the intake resistance, so that the engine output can be raised.

Another object of the invention is to provide a two-cycle engine, in which a carburetor is able to be brought close to a valve cover, thereby raising the space efficiency and rendering shorter an intake tube, while eliminating a connection work between the valve cover and the intake tube.

Still another object of the invention is to provide a two-cycle engine, in which a breathing system adapted for the breathing of a crank chamber can be integrally provided, without modifying a basic structural design of an ordinary rotary valve type two-cycle engine, thus making unnecessary the conventional additive provision thereof, thereby permitting a small-sized and light-weighted engine design.

The above and further features, objects and advantages of the present invention will more fully appear from the following detailed description of the preferred embodiment of the invention when the same is read in conjunction with the accompanying drawings.

DETAILED DESCRIPTION OF THE PREFERRED EMBODIMENT

Figure 1:
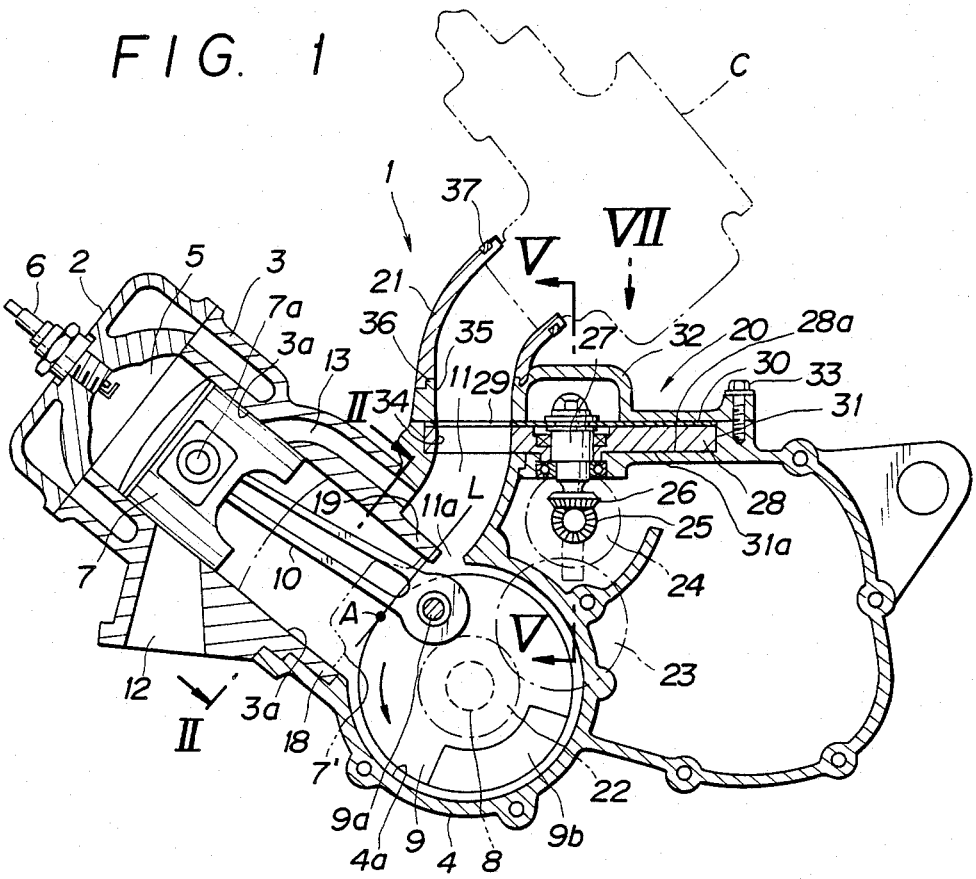
FIG. 1 is a longitudinal sectional view of a rotary valve type two-cycle engine according to the preferred embodiment of the present invention.

FIG. 1 is a longitudinal sectional view of a rotary valve type two-cycle engine according to a preferred embodiment of the invention, seen from the left of a vehicle body of a motorcycle equipped with the engine, in which view the left corresponds to a direction toward the front of the motorcycle and the right, to that toward the rear thereof.

In FIG. 1, designated at reference numeral 1 is an entire body of the two-cycle engine. The engine body 1 has integrally jointed thereto a cylinder head 2, a cylinder block 3, and a crankcase 4 with a crank member **4*a* formed therein. The cylinder head has screwed therethrough an ignition plug 6 of which sparking end fronts a combustion chamber 5 in the upper part of a cylinder 3*a* defining a cylinder chamber, the cylinder 3*a* being formed in the cylinder block 3 so as to ascend frontwardly of the motorcycle. In the cylinder 3*a* is slidably fitted a piston 7, and in the crankcase 4, rotatably supported a crankshaft 8 extending transversely of the motorcycle. The crankshaft 8 is provided with a pair of disc-like crank webs 9 fixed thereon at their center, the webs 9 transversely opposing each other (in FIG. 1, right one only is shown). Each crank web 9 has fixed to the side face thereof a crank pin 9*a* interconnected through a connecting rod 10 with a piston pin 7*a* fixed to the piston 7, whereby a reciprocation of the piston 7 is converted into a rotation of the crankshaft 8. Each crank web 9 is provided with a balance weight 9*b* arranged so as to have a position symmetrical therewith substantially by 180 degrees with respect to the crankshaft 8**.

In the upper front part of the crankcase 4 is formed an intake port 11 communicating through an intake opening **11*a* with the lower part of the cylinder chamber and having its axis directed perpendicular to the crankshaft 8 in the vicinity of that ending portion of the cylinder 3*a* which is located on the crankshaft 8 side, the axis extending substantially along a tangential line L the crank web 9 defines at a top point A thereof on the cylinder 7 side. The intake port 11 is connected to a carburetor C through a rotary intake valve 20 provided in the upper part of the engine body 1 and an intake tube 21 as a heat insulating anti-vibratory member. The rotary intake valve 20 comprises a valve shaft 27 directed upright so as to extend perpendicularly to the crankshaft 8 (the valve shaft 27 having an unshown extension), which valve shaft 27 is driven to rotate by the crankshaft 8 through the combination of a train of spur gears 22, 23, 24 and a pair of bevel gears 25, 26, a valve guide plate 28 having a predetermined thickness and a central through hole rotatably guiding and supporting the valve shaft 27, and a rotary disc 30 placed to be supported on the guide plate 28 and secured at the center thereof to the valve shaft 27, the rotary disc 30 extending across the intake port 11 so as to shut the same and rotating together with the valve shaft 27. The rotation of the rotary disc 30 is thus synchronized with that of the crankshaft 8, so that a valve hole 29 formed through the rotary disc 30 just passes to open the intake port 11 in the intake stroke of the piston 7**.

Moreover, the valve guide plate 28 of the rotary intake valve 20 is fitted in an upwardly opened cylindrical recess 31 formed in a top wall portion of the crankcase 4. Further, above the rotary disc 30 is disposed a valve cover 32 fastened with bolts 33 to the crankcase 4 to protect from above the rotary disc 30.

More particularly, the cylindrical recess 31 is formed so as to constitute at the bottom thereof a mount seat 31*a* for mounting thereon the valve guide plate 28 of the rotary valve 20, while the bottom of the valve guide plate 28 is formed as a mount face 18*a* fittable onto the mount seat 31*a*. Between the mount face 28*a* and the mount seat 31*a*, there is interposed a substantially circular sheet-like gasket 42 detailed later in conjunction with FIGS. 5 and 6.

The valve guide plate 28 and the valve cover 32 have intake holes 34, 35 opened therethrough correspondingly to the intake port 11, respectively, to permit the upper end opening of the intake port 11 to communicate with the lower end opening of the intake tube 21. Furthermore, the intake tube 21 is integrally baked at the lower end thereof onto the outer circumference of an annular projection 36 formed along the circumferential edge of that one of open ends of the intake hole 35 in the valve cover 32 which is located on the upper side or at the carburetor C side, whereas the intake tube 21 has at the upper end thereof a connecting portion tightened with a clamp 37, to be connected to the carburetor C.

Incidentally, the crankcase 4 is of a separatable type consisting of a left half 40 and a right half 41, as later described in conjunction with FIG. 5. An unshown transmission is disposed aside of the crankcase 8.

Figure 2:
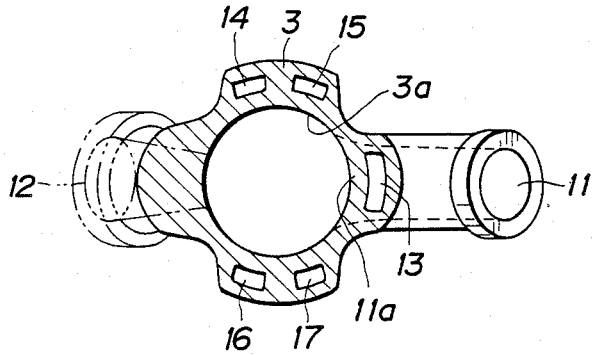
FIG. 2 is a sectional view taken along line II—II of FIG. 1.

Referring now to FIG. 2, opposite to the intake port 11, the cylinder block 3 has formed across the wall thereof an exhaust port 12 permitting the combustion chamber 5 in the cylinder 3*a* to communicate with an exhaust system of the engine in the exhaust stroke of the piston 7. Moreover, in the wall of the cylinder block 3, at the intake port 11 side, there is axially formed a scavenging port 13 permitting the combustion chamber 5 to communicate with the intake port 11 in the scavenging or transfer stroke of the piston 7, and at diametrically opposed sides thereof circumferentially spaced substantially by 90 degrees from the scavenging port 13, there are again axially formed two pair of paralleled additional scavenging ports 14, 15 and 16, 17 likewise interconnecting the inside of the cylinder 3*a* with that of the crankcase 4 in the scavenging stroke of the piston 7. In order to hold to support from around the piston 7, to thereby prevent the swaying thereof, when it has come down to its bottom dead center 7′ as shown by alternate long and two short dashes line in FIG. 1, the cylinder 3*a* perpendicular of its axis to the crankshaft 8 has downwardly projected therefrom a pair of cylinder skirt portions 18, 19 diametrically opposing each other.

Figure 3:
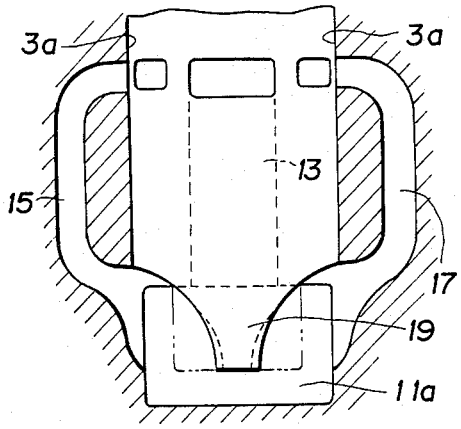
FIG. 3 is a longitudinal sectional view of an essential part of the engine of FIG. 1.

FIG. 3 is a longitudinal sectional view about the intake opening 11*a* as seen from inside of the cylinder 3*a*. As shown by alternate long and two short dashes line in FIG. 3, in a conventional arrangement, a corresponding cylinder skirt portion with a relatively wide arc length is formed to be straightly projected in front of an intake port, thus restricting the opening area of the intake port. In the engine according to the preferred embodiment of the invention, that one of the cylinder skirt portions 18, 19 which fronts the intake port 11, i.e., the cylinder skirt portion 19, has its both sides cut symmetrically with respect to the axial centerline of the cylinder 3*a*, leaving a projection of an inverted triangular configuration, to thereby secure a sufficient sectional area at the end opening 11*a* of the intake port 11, whereas, to effect such securement of sectional area, the part to be cut is not limited to the both sides of the cylinder skirt portion 19. In this respect, however, for example, where a central part of the cylinder skirt portion 19 is cut, the connecting rod 10 as in the intake stroke of the piston 7 comes to the intake port 11 side past the center of the cylinder 3*a*, taking a position in which it just blocks the cut central part of the cylinder skirt portion 19, thus insignificantly affecting the intended enlargement of sectional area at the end opening 11*a* of the intake port 11. In other words, to avoid such a purposeless affection, the embodiment has preferably employed the inverted triangular projection made by cutting both sides of the cylinder skirt portion 19. According to the embodiment, on the contrary, there is given such an additional advantage that the respective balance weights 9*b* of the crank webs 9 supporting the connecting rod 10 from both sides thereof, as the piston 7 is put in its initial position of the intake stroke, are each respectively positioned so as to block one of both cut parts of the cylinder skirt portion 19, wherefor, in the subsequent ascent of the piston 7 to enter the intake stroke, the balance weights 9*b* are caused to retreat from the cut parts of the cylinder skirt portion 19, thus making by themselves a sort of aspiratory pumping effect, thereby effectively raising the charging efficiency of fresh mixture. Moreover, for a maintained original length of the cylinder skirt portion 19 in the axial direction of the cylinder 3*a*, the piston 7 is favorably supported along its entire length with the cylinder wall, thus being kept from swaying, even when it has slided down in the cylinder 3*a* to the bottom dead center. Incidentally, the remaining one of the cylinder skirt portions 18, 19, i.e., the cylinder skirt portion 18, has its ordinary configuration kept without cutting.

Figure 4:
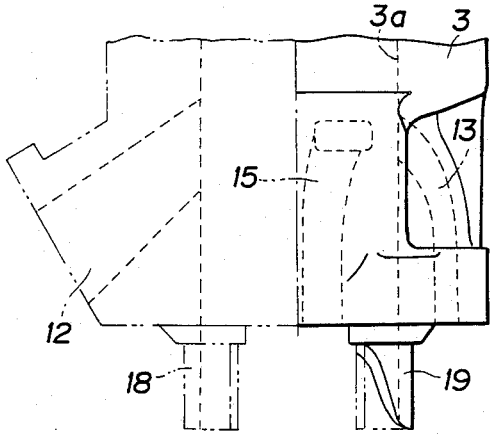
FIG. 4 is a side view of an essential part of a cylinder block of the engine of FIG. 1.

FIG. 4 is inserted to show a side elevation of an essential part of the cylinder block 3, whereby the cylinder skirt portion 19 can be easily comprehended of the inversed triangular configuration in its side view.

In the above-described two-stroke cycle internal combustion engine, as the piston 7 travels upwardly from the bottom dead center to enter the intake and compression stroke, the rotary intake valve 20 in the intake port 11 performs an open-close action synchronized with the number of revolutions of the engine, and an increasing volume of the cylinder 3*a* under the piston 7 causes a corresponding volume of fresh mixture to be taken therein as well as into the crankcase 4. More particularly, the mixture is introduced from the intake port 11, which is extended substantially along the tangential line L the crank webs 9 define at the top point A thereof on the cylinder 3*a* side, through the end opening 11*a* directly into the volume-increasing cylinder 3*a*. At this time, for the intake port 11 is secured of the sectional area at the end opening 11*a* with the cylinder skirt portion 19 cut at the both sides, which otherwise may restrict the sectional area in concern, into the inversed triangular configuration, the intake resistance is rendered very small, besides that because of the maintained original axial length of the cylinder skirt portion 19 the piston 7 is supported along the entire length, thus being effectively prevented against swaying, even when it is located in the bottom dead center, as already described. Moreover, when the piston 7 enters the intake stroke, i.e., as it ascends from the bottom dead center, the respective balance weights 9*b* of the crank webs 9 move in their opening direction from the closing position of the end opening 11*a* of the intake port 11, thus exhibiting a kind of aspiratory pumping effect to assist the intake action. Further, in the case of a rotary intake valve backing type engine, an intake port may be disposed in the vicinity of the lower end of a cylinder, to thereby shorten the intake port length, thus reducing the intake resistance. According to the embodiment, the engine output is successfully raised with the foregoing effects.

Furthermore, in the above-described arrangement, the intake tube 21 is integrally baked to the annular projection 36 of the intake hole 35 opened in the valve cover 32, without the need of an annular extension of the intake hole 35 which extension would otherwise be necessary for fitting thereon a clamp band, thus effecting a corresponding length reduction of the intake tube 21, resulting in a relatively small intake resistance, whereby the mixture feed from the carburetor C to the crank chamber 4*c* is favorably smoothed.

Still more, the unnecessity of the clamp band between the intake tube 21 and the intake hole 35 of the valve cover 32 has eliminated the conventional need of a installation space for the clamp band, resulting in a raised space efficiency achieved by a possible approach of the carburetor C toward valve cover 32, as well as a shorter length of the intake tube 21, in addition to the elimination of a fastening work which would otherwise be needed between the intake tube 21 and the valve cover 32.

Incidentally, the foregoing intake port arrangement as well as the integration of an intake tube with a valve cover is obviously applicable to any two-cycle engine which, instead of a rotary valve, has employed another type of valve such as a reed valve. Further, there may be employed a crank web of other configuration than circular.

Figure 5:
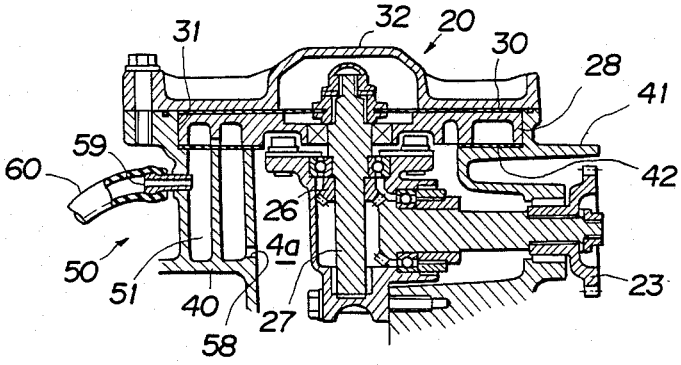
FIG. 5 is a longitudinal sectional view taken along line V—V of FIG. 1.

FIG. 5 is a sectional view taken along line V—V of FIG. 1, showing an upper part of the crankcase 4 and associated essential parts of the engine as sectioned along the center axis of the valve shaft 27 in the transverse direction of the motorcycle, in which view the left and right correspond to those of the motorcycle, respectively.

As shown in FIG. 5, the two-cycle engine has a breathing mechanism 50 for permitting the crank chamber 4*a* to communicate with the atmosphere, the breathing mechanism 50 being constituted with an upper portion of the left half member 40 of the crankcase 4 and a part of the valve guide plate 28 cooperating therewith.

Figure 6:
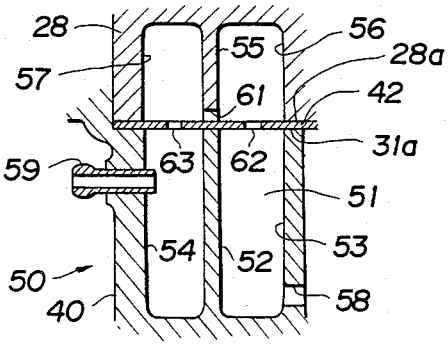
FIG. 6 is an enlarged view of a breather chamber shown in FIG. 5.

More particularly, as seen from FIG. 6, the breathing mechanism 50 comprises a breather chamber 51 cooperatively constituted with a pair of lower recesses 53, 54 formed, with a lower partition wall 52 left therebetween, in the mount seat 31*a* of the left half member 40 of the crankcase 4 and with a corresponding pair of upper recesses 56, 57 formed, with an upper partition wall 55 left therebetween and with respectively smaller volumes than the lower recesses 53, 54, in the mount face 28*a* of the valve guide plate 28. As described before, between the mount face 28*a* and the mount seat 31*a*, there is inserted the substantially circular gasket 42, which is thus adapted to separate respective pair of mutually opposing upper and lower recesses 53, 56 and 54, 57 from each other.

Of the lower recesses 53, 54 in the left half member 40, the inner one 53 has opened through its inner wall an inlet hole 58 communicating with the crank chamber 4*a*, while the remaining outer one 54 has inserted thereinto through its outer wall an outlet pipe 59 projecting outwardly of the left half member 40. The outlet pipe 59 is connected to a breathing tube 60, so that the outer lower recess 54 communicates with the atmosphere.

The upper partition wall 55 has formed in the lower end thereof a slot 61 interconnecting the inner and outer upper recesses 56, 57 in the valve guide plate 28. The inner and outer upper recesses 56, 57 are let to communicate with the inner and outer lower recesses 53, 54, respectively, through inner and outer communication holes 62, 63 formed in the gasket 42, respectively.

Accordingly, fuel-air mixture in the crank chamber 4*a* is permitted to inflow first through the inlet hole 58 to the inner lower recess 53, then subsequently, through the communication hole 62 to the inner upper recess 56, through the slot 61 to the outer upper recess 67, and through the communication hole 63 to the outer lower recess 54. While passing such complicated route, the mixture has its oil content separated, thus leaving air only discharged through the outlet pipe 59 and the breathing tube 60 to the atmosphere, thereby keeping constant the inner pressure of the crankcase 4.

Figure 7:
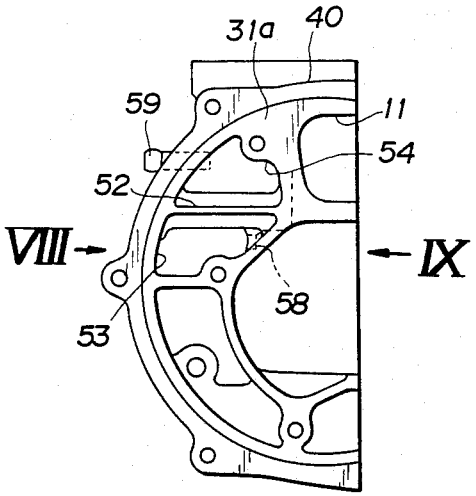
FIG. 7 is a top view of a left half member of a crankcase, as seen along arrow VII of FIG. 1.

FIG. 7 is a partial top view of the left half member 40 of the crankcase 4 as seen along arrow VII of FIG. 1, in which view the left and right corresponds to those of the motorcycle, respectively.

Figure 8:
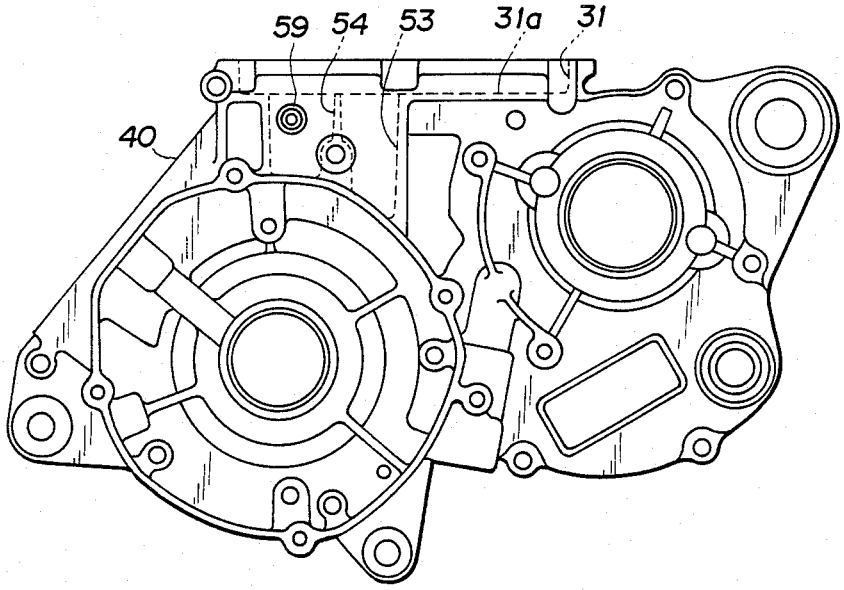
FIG. 8 is a left-side view of the left half member of the crankcase, as seen along arrow VIII of FIG. 7.

FIG. 8 is a left-side view of the left half member 40 of the crankcase 4 as seen along arrow VIII of FIG. 7, in which view the left corresponds to a direction toward the front of the motorcycle.

Figure 9:
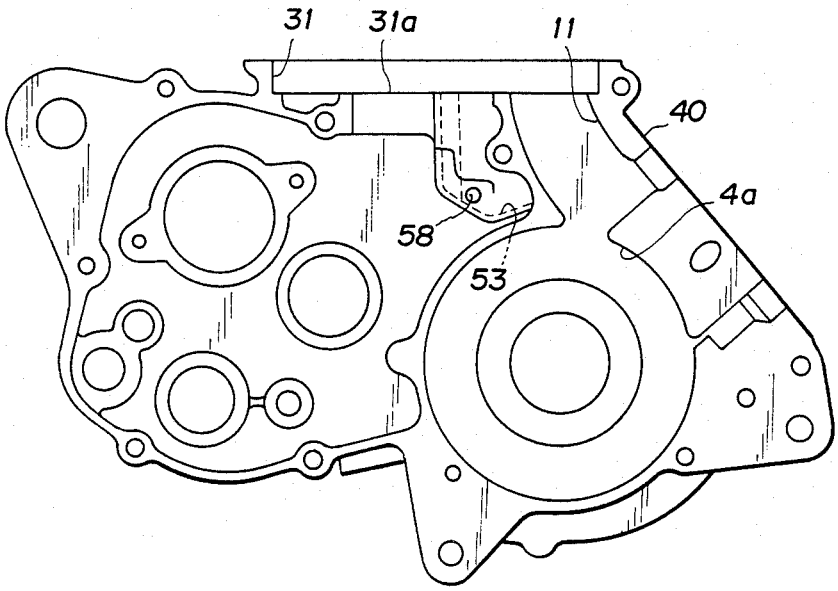
FIG. 9 is a right-side view of the left half member of the crankcase, as seen along arrow IX of FIG. 7.

FIG. 9 is a right-side view of the left half member 40 of the crankcase 4 as seen along arrow IX of FIG. 7, thus showing the inside of the left half member 40.

Figure 10:
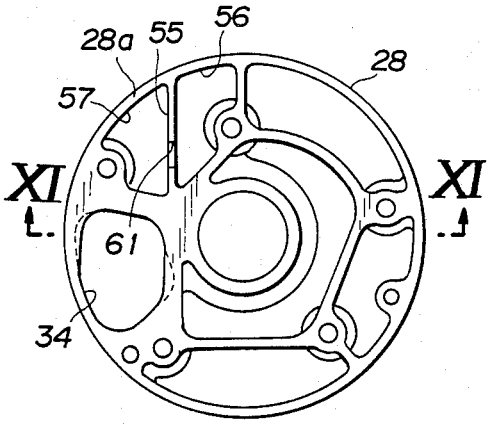
FIG. 10 is a bottom view of a valve guide plate of the engine of FIG. 1.

FIG. 10 is a bottom view of the valve guide plate 28 which is stationary while the engine is running.

Figure 11:
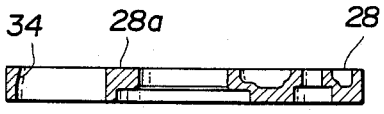
FIG. 11 is a sectional view taken along line XI—XI of FIG. 10.

FIG. 11 is a sectional view taken along line XI—XI of FIG. 10, in which view the vertical direction is inversed with respect to a practical mounting of the valve guide plate 28.

As described hitherto, according to the invention, a two-stroke engine has a breathing mechanism, besides distinctive features concerning the arrangement of an intake port, the configuration of a cylinder skirt, and the connection of an intake tube to a valve cover.

In the preferred embodiment, the breathing mechanism comprises a breather chamber constituted with a pair of recesses formed in a thick portion of a left half member of a crankcase and with another pair of recesses formed in a mount face of a valve guide plate, and a gasket inserted for separation between the recesses in the crankcase and the corresponding recesses in the valve guide member, the gasket being inherently employed for mounting a rotary valve on the crankcase, so that a breathing system for a crank chamber is permitted to be integrally provided without the need of modifying a basic structural design of ordinary two-cycle engines, whereby eliminated is the conventional additive provision of breathing system, thus resulting in a possible light-weighted engine design of smaller sizes.

Moveover, a larger part of the breather chamber is formed in the thick portion of the crankcase, thus permitting a sufficient breathing capacity to be secured. Further, the four recesses are subsequently connected through small holes, thereby effectively rendering complicate the route of fuel-air mixture between the crank chamber and the atmosphere, favorably securing a sufficient ability to separate fuel and air in the breathing mechanism.

Furthermore, the recesses formed in the valve guide plate placed above the crankcase is utilized as a part of the breather chamber, thus satisfying the known requirement that a breather chamber should be disposed above a transmission.

In the preferred embodiment, a breathing mechanism is provided in a region consisting of an upper portion of a left half member of a crankcase and a corresponding part of a valve guide plate, as described above. In this respect, in a modified example, a breathing mechanism may be provided in a region including an upper portion of a right half member of a crankcase and a corresponding part of a valve guide member. In other words, a breathing chamber may be disposed in an optimum region extending from an upper portion of a crankcase to a corresponding part of a valve guide member.

Figure 12:
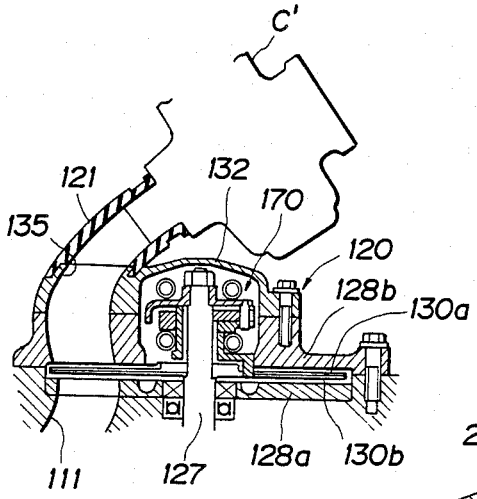
FIG. 12 is a view showing a rotary valve and an intake tube according to a modified example of the preferred embodiment.

FIG. 12 is a sectional view showing an essential part of engine including a rotary valve and an intake tube according to a modified example of the preferred embodiment.

In FIG. 12, designated at reference numeral 120 is the rotary valve, and 121 is the intake tube. The rotary valve 120 comprises an upper rotary disc 130*a*, a lower rotary disc 130*b*, and a governor 170 equipped to the upper part of a rotary valve shaft 127. The governor 170 is adapted to make the phase difference between the upper and lower rotary discs 130*a*, 130*b* vary with the number of revolutions of engine, to thereby effect an automatic control such as of the rate and timing of mixture feed from a carburetor C' to a crank chamber in accordance with the engine revolution number.

In this modified example, for accommodating the governor 170, besides a valve guide plate 128*a* disposed on the lower face of the lower rotary disc 130*b*, there is provided another valve guide plate 128*b* on the upper face of the upper rotary disc 130*a*, the valve guide plate 128*b* being proteced from above with a valve cover 132. To an intake hole 135 formed in the valve cover 132, the intake tube 121 is integrally baked to be connected.

Figure 13:
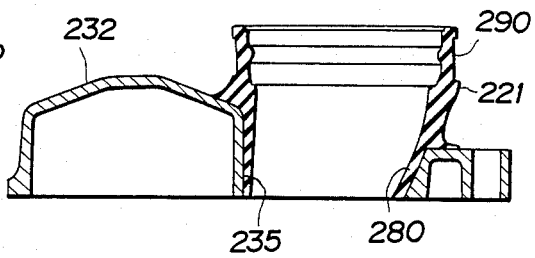
FIG. 13 is a view showing an intake tube according to another modified example of the preferred embodiment.

FIG. 13 shows an intake tube according to another modified example of the preferred embodiment. In FIG. 13, designated at reference numeral 221 is the intake tube. Like the embodiment, the intake tube 221 is integrally baked to an intake hole 235 formed in a valve cover 232. In this example, however, the intake tube 221 has an end portion 280 extended to be baked over the entire area of the inner circumference of that one of both end openings of the intake hole 235 which is located at the side of a carburetor, thereby causing the heat resistive nature of the intake tube 221 to be effectively exhibited in the intake hole 235 as well, whereby a resistive effect against the engine heat transfer to the carburetor is secured with the intake tube 221, thus permitting the carburetor to be disposed nearer to the valve cover 232, obtaining a higher space efficiency. Incidentally, in FIG. 13, designated at reference numeral 290 is a groove adapted to fit thereon a clamp band for the connection to the carburetor.

In the foregoing modified examples, an intake tube is integrally fastened by baking to an intake hole formed in a valve cover. However, such a fastening may be effected by other than baking, i.e., by use of an adhesive agent for example.

As will be understood from the foregoing description, also the modified examples associated with FIGS. 12 and 13 have an intake tube possibly reduced of its length, while successfully eliminating a connection work which would otherwise be needed between a valve cover and the intake tube, in addition to other favorable effects.

Although there has been described what is at present considered to be the preferred embodiment of the invention, it will be understood that the present invention may be embodied in other specific forms without departing from the spirit or essential characteristics thereof. The present embodiment is therefore to be considered in all respects as illustrative and not restrective. The scope of the invention is indicated by the appended claims rather than by the foregoing description.

What is claimed is:

1. A two-cycle engine intended for use in a motorcycle, including:

an engine body having formed therein a crank chamber, and an intake port for introducing fuel-air mixture from a carburetor installed outside of said engine body to said crank chamber;

said engine body having therein a cylinder defining a cylinder chamber communicatable with said crank chamber, and at least a cylinder skirt portion extending so as to block an end opening as a cylinder opening of said intake port, said skirt portion having both sides thereof cut symmetrically with respect to the axis of the cylinder while keeping the length thereof in the axial direction of said cylinder, said cylinder being directed such that the axis thereof ascends from said crank chamber frontwardly of said motorcycle, said intake port being directed so as to ascend from between said crank chamber and said cylinder chamber rearwardly of said motorcycle;

a piston slidably fitted in said cylinder;

a crank shaft rotatably arranged in said crank chamber perpendicularly to the center axis of said cylinder and directed transversely of said motorcycle, said intake port extending in a direction perpendicular to said crankshaft;

at least one substantially disc-like crank web fixed at the central part thereof to said crankshaft, said intake port being arranged to as to extend substantially along a tangential line said crank web defines at a top point thereof on the side of said cylinder;

a connecting rod operatively interconnecting said crankshaft with said piston;

rotary valve means provided for said engine body and operatively connected to said crankshaft so as to open and close an end opening of said intake port on the side of said carburetor in accordance with the stroke of said piston;

said rotary valve means consisting of a valve shaft directed upright to extend perpendicularly to said crankshaft and operatively connected to said crankshaft, a rotary disc fixed at the central part thereof to said valve shaft and adapted to be located at a part thereof in said intake port so as to shut said intake port, said rotary disc having at least one valve opening, and a valve cover mounted on said engine body so as to cover said rotary disc and fromed with an intake hole corresponding to said intake port; and an intake tube for connecting said intake hole of said valve cover to said carburetor, said intake tube being fastened to said intake hole of said valve cover so as to be integral therewith.

2. A two-cycle engine according to claim 1, wherein:
said intake tube is integrally baked to the outer circumference of an annular projection formed about an end opening of said intake hole of said valve cover on the side of said carburetor.

3. A two-cycle engine according to claim 1, wherein:
said intake tube is integrally baked to the inner circumference of an end opening of said intake hole of said valve cover on the side of said carburetor.

4. A two-cycle engine according to claim 1, wherein:
said rotary valve means further includes a valve guide plate of a predetermined thickness, said valve guide plate having a central support hole for rotatably supporting said valve shaft, and an intake hole formed corresponding to said intake port;
said engine body has in the upper face thereof a circular recess opened upwardly and formed at the bottom thereof as a mount seat for said valve guide plate;
the bottom face of said valve guide plate is formed as a mount face fittable to said mount seat;
said valve guide plate is fitted in said circular recess;
said rotary disc is supported by the upper face of said valve guide plate; and
a breather chamber is cooperatively constituted with a first recess formed in said mount seat of said engine body and with a second recess formed correspondingly to said first recess in said mount face of said valve guide plate.

5. A two-cycle engine according to claim 4, wherein:
said first recess has a volume larger than that of said second recess.

6. A two-cycle engine according to claim 5, wherein:
said mount seat of said engine body and said said mount face of said valve guide plate have a substantially disc-like gasket interposed therebetween;
said first recess has formed therein a first partition wall for separating said first recess into a third recess and a fourth recess;
said second recess has formed therein a second partition wall for separating said second recess into a fifth recess and a sixth recess corresponding to said third recess and said fourth recess, respectively;
said third recess is interconnected with said crank chamber through an inlet hole formed therebetween;
said fifth recess is interconnected with said third recess through a communication hole formed in a portion of said gasket lying therebetween;
said second partition wall has formed therethrough a slot interconnecting said fifth recess and said sixth recess with each other;
said sixth recess is interconnected with said fourth recess through a communication hole formed in a poriotn of said gasket lying therebetween; and
said fourth recess in connected to the atmosphere.

7. A two-cycle engine according to claim 1, wherein:
said engine body comprises a crankcase formed with said crank chamber and provided with said rotary valve means, a cylinder block provided with said cylinder and integrally jointed to said crankcase, and a cylinder head integrally jointed to said cylinder block.

* * * * *